United States Patent [19]

DeWitt

[11] Patent Number: 5,028,900

[45] Date of Patent: Jul. 2, 1991

[54] DAMPER FOR A ROTARY SOLENOID

[75] Inventor: Robert R. DeWitt, Marlton, N.J.

[73] Assignee: Opex Corporation, Moorestown, N.J.

[21] Appl. No.: 473,881

[22] Filed: Feb. 5, 1990

[51] Int. Cl.[5] ..... H01F 7/08

[52] U.S. Cl. ..... 335/228; 335/272; 335/271; 335/277

[58] Field of Search ..... 335/228, 272, 277, 257

[56] References Cited

U.S. PATENT DOCUMENTS 4,816,793 3/1989 Lulich ..... 335/104

*Primary Examiner*—Leo P. Picard

*Assistant Examiner*—Ramon M. Barrera

*Attorney, Agent, or Firm*—Weiser & Stapler

[57] ABSTRACT

To reduce noise, impact forces and bouncing, the shaft of a rotary solenoid is provided with a dampening mechanism which generally includes a resilient dampening element and a cooperating collar which are axially disposed about the rotating shaft of the solenoid. Following activation of the rotary solenoid, the resilient element is drawn into contact with the housing, developing friction between the rotating resilient element and the housing of the rotary solenoid which operates to bring rotation of the shaft to a controlled stop.

6 Claims, 2 Drawing Sheets

DAMPER FOR A ROTARY SOLENOID

BACKGROUND OF THE INVENTION

The present invention relates generally to rotary solenoids, and more particularly, to a means for dampening vibrations resulting from the operation of such solenoids.

Various different types of solenoids have long been used to cause a mechanical movement responsive to an applied electrical signal. This can include longitudinal movements resulting from the reciprocation of a core (or slug) within a wound coil for receiving the applied electric signal. This can also include rotational movements of a shaft within a housing, responsive to reciprocation of the shaft within the wound coil. The present application is primarily directed to the latter of these two solenoid types.

While also present in solenoids with longitudinally moving cores, one disadvantage which often presents itself in connection with rotary solenoids is that of noise and vibration resulting from impacts between the internal components of the solenoid (or components of the driven load) upon reaching the end of their available travel.

Steps have been taken to address this problem, yet none have been entirely satisfactory. For example, it is possible to dampen vibrations of this general type by providing fixed stops having resilient surfaces which dampen impacts resulting from full travels of the solenoid (or the driven load). While this tends to reduce the amount of noise and impact forces which are produced, such measures can at times produce unacceptable bouncing of the solenoid's internal components (or components of the driven load) due to the resiliency of the stopper which is employed.

It therefore remained desirable to develop a damper for a rotary solenoid which is not only able to reduce unwanted noise and impact forces, but which is further able to reduce bouncing resulting from impacts of elements of the solenoid, or its associated driven load.

SUMMARY OF THE INVENTION

It is therefore a primary object of the present invention to provide an improved damper for a rotary solenoid.

It is also an object of the present invention to provide a damper for a rotary solenoid which is capable of reducing noise, impact forces and bouncing resulting from impacts of elements of the solenoid, or its associated driven load.

It is also an object of the present invention to provide a damper for a rotary solenoid which is easily implemented, cost effective, and therefore effectively employed in conjunction with a relatively inexpensive component such as a rotary solenoid.

These and other objects are achieved in accordance with the present invention by providing the shaft of a rotary solenoid with a dampening mechanism which generally includes a resilient dampening element and a cooperating collar which are axially disposed about the rotating shaft of the solenoid. In operation, following activation of the rotary solenoid, the resilient element is drawn into contact with the housing. Under the influence of the collar, the resilient element is compressed and twisted. This in turn develops both frictional and flexural resistance to further motion, restricting axial motion and preventing further torque generation.

Under these influences, the load decelerates to a controlled stop, minimizing both impacts and bouncing of the components involved.

For further detail regarding a damper for a rotary solenoid which is produced in accordance with the present invention, reference is made to the detailed description which is provided below, taken in conjunction with the following illustrations.

BRIEF DESCRIPTION OF THE DRAWINGS

In the several views provided, like reference numbers denote similar structure.

DETAILED DESCRIPTION OF THE PREFERRED EMBODIMENT

Figure 1:
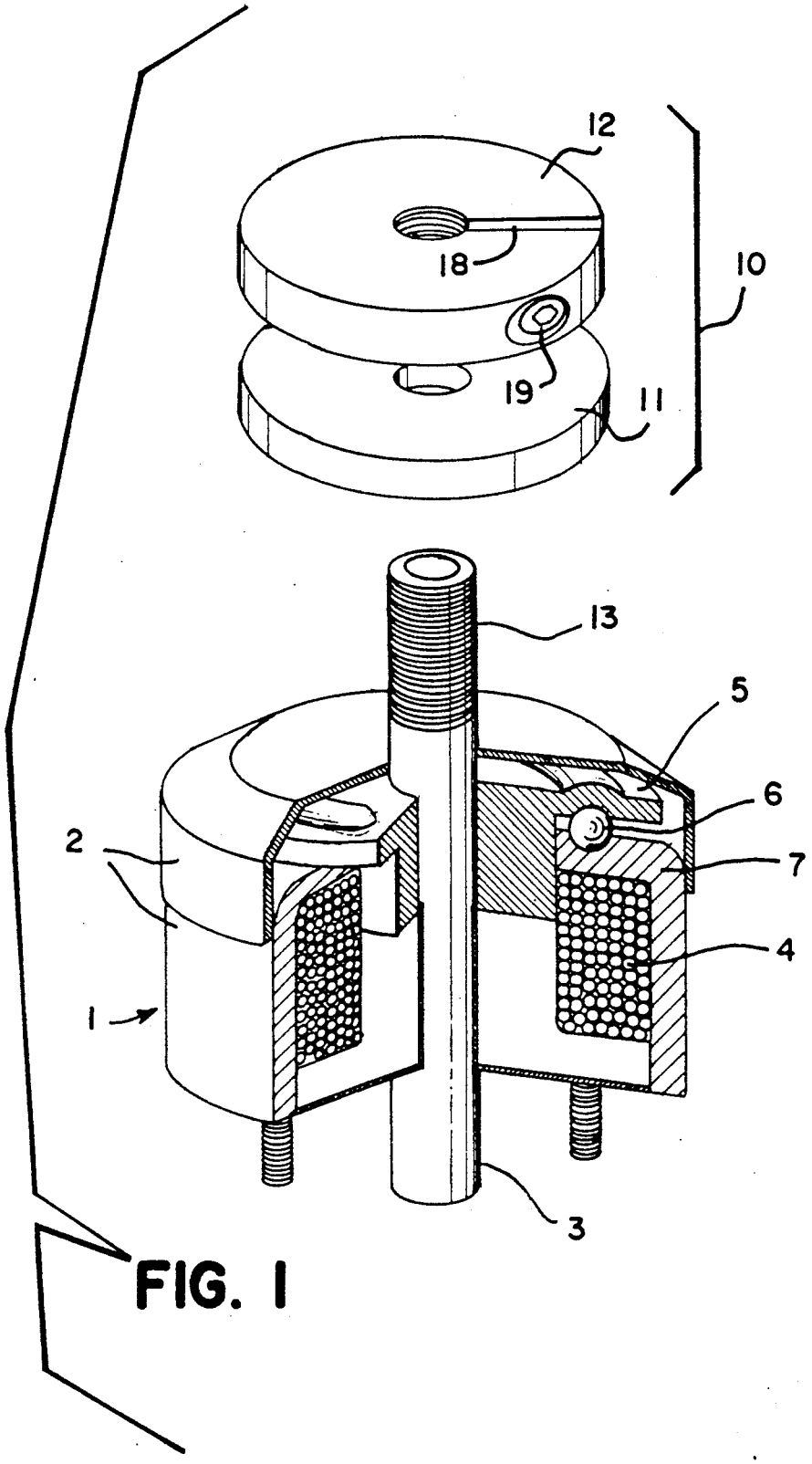
FIG. 1 is a partially sectioned, exploded isometric view of the rotary solenoid and its dampening assembly.

As illustrated in the drawings, the rotary solenoid 1 is externally comprised of a housing 2 and a central shaft 3 extending from the housing 2. Operation of the rotary solenoid 1 is fully conventional, and a variety of rotary solenoids of this general type are commercially available from vendors such as Lucas Ledex, Inc. of Vandalia, Ohio, among others. However, for purposes of explaining the improvements of the present invention, a basic understanding of the operation of a rotary solenoid will now be provided.

The central shaft 3 is longitudinally movable within the housing 2 responsive to an applied magnetic field developed by a coiled winding 4 which is also contained within the housing 2. The central shaft 3 is further provided with a plate 5 having a helical groove for receiving a series of ball bearings 6 which interconnect the helical groove of the plate 5 with fixed portions 7 of the rotary solenoid 1. This operates to translate longitudinal movements of the central shaft 3 into rotary movements as well.

This otherwise conventional rotary solenoid is in accordance with the present invention provided with a damper 10 which is generally comprised of a resilient element 11 and a collar 12 overlying the resilient element 11. The resilient element 11 may be formed of any of a variety of available materials, preferably an elastomer. The collar 12 may be formed of any of a variety of rigid materials, preferably a metal such as aluminum or steel. The damper 10 is fixed to extended portions 13 of the central shaft 3, which are preferably threaded to receive the damper 10 in a manner which facilitates adjustment of the damper 10 as will be described more fully below.

Figure 2:
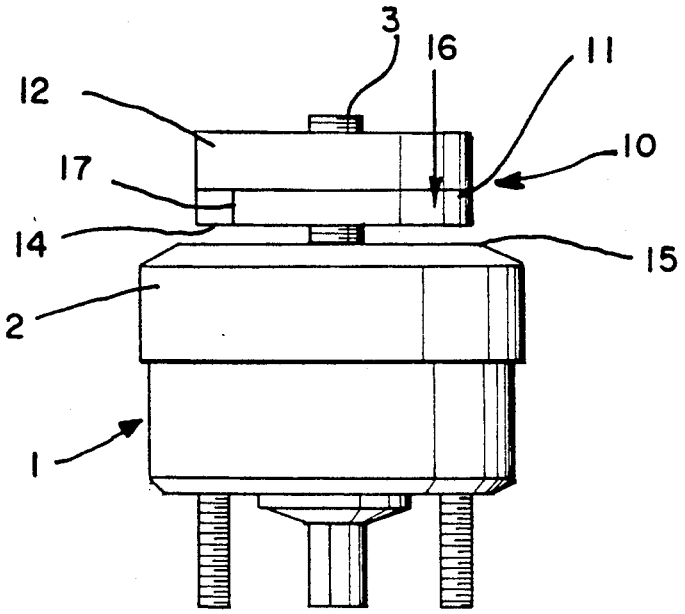
FIG. 2 is a side elevational view of portions of the rotary solenoid, and the dampening assembly of FIG. 1, at rest.
Figure 3:
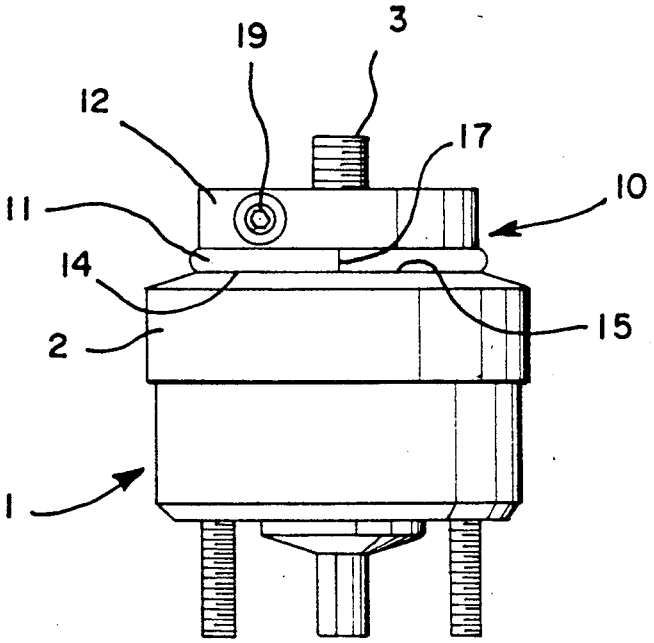
FIG. 3 is a side elevational view similar to that of FIG. 2, following actuation of the solenoid.

Referring now to FIGS. 2 and 3, operation of the damper 10 will now be described. At rest, the damper 10 will remain affixed to the central shaft 3 so that the exposed face 14 of the resilient element 11 is spaced from the rear face 15 of 10 the housing 2. This then permits free travel of the central shaft 3 responsive to operations of the rotary solenoid 1. Upon operation of the rotary solenoid 1, the central shaft 3 will be caused to rotate in conventional fashion. As previously indicated, this will at the same time cause a longitudinal 15 movement of the central shaft 3, in the general direction of the arrow 16. Referring now to FIG. 3, this operates to draw the exposed face 14 of the resilient element 11 into contact with the rear face 15 of the housing 2, following the progressive helical movement of the central shaft 3 relative to the housing 2 of the rotary solenoid 1.

In addition to dampening noise and impact forces, resulting from the relatively soft contact which is developed between the resilient element 11 and the housing 2, this further operates to reduce bouncing as a result of the rotational friction which is developed between the resilient element 11 and the housing 2 as these two elements come into contact with, and rotate relative to each other. This is best illustrated in comparing FIG. 2 and FIG. 3, noting movement of the marked position shown at 17 both longitudinally, and rotationally. The frictional and flexural resistance which is developed as a result of this operates to decelerate the central shaft 3 (and its driven load) to a controlled stop rather than the sudden stop which was previously encountered. This has been found to be useful in effectively reducing the noise, impact forces, and particularly the bouncing previously encountered with fixed stops and the like. To be noted is that the amount of compression and friction developed between the resilient element 11 and the housing 2 may be varied, as desired, by appropriately selecting the material used to form the resilient element 11.

To further control the amount of compression and friction which is developed following activation of the rotary solenoid 1, and to ensure a maximum free rotation of the central shaft 3 upon activation, prior to contact between the damper 10 and the housing 2, the damper 10 is preferably made adjustable along the central shaft 3. Any of a variety of mechanisms may be used for this purpose. However, a preferred means for accomplishing this is to provide the extended portion 13 of the central shaft 3 with threads for engaging a threaded central aperture formed in the collar 12, so that rotation of the collar 12 will in turn adjust the spacing between the resilient element 11 and the housing 2. A slotted clamp 18 is provided to maintain the desired adjustment, once made, by tightening the set screw It will be understood that various changes in the details, materials and arrangement of parts which have been herein described and illustrated in order to explain the nature of this invention may be made by those skilled in the art within the principle and scope of the invention as expressed in the following claims.

What is claimed is:

1. A rotary solenoid comprising a housing for containing a shaft which is caused to rotate upon reciprocation of said shaft, and a damper for dampening impacts and vibrations resulting from reciprocations and rotations of said shaft, wherein said damper comprises:

a resilient element received by said shaft for movement relative to said housing and into contact with surface portions of said housing; and a collar overlying said resilient element and connected to said shaft.

2. The rotary solenoid of claim 1 wherein said resilient element is formed of a material for developing friction between surface portions of said resilient element and said surface portions of the housing.

3. The rotary solenoid of claim 1 said damper is received by extended portions of said shaft.

4. The rotary solenoid of claim 3 wherein said damper is adjustably received by said extended shaft portions.

5. The rotary solenoid of claim 4 wherein said extended shaft portions are threaded for engaging threaded portions of said damper.

6. A method for dampening noise and vibration in a rotary solenoid including a housing for containing a shaft which is caused to rotate upon reciprocation of said shaft, said method comprising the steps of:

advancing a resilient element associated with said shaft into contact with surface portions of said housing following actuation of said rotary solenoid;

producing frictional and flexural resistance to further movement of said shaft upon contact with said surface portions of said housing; and decelerating said shaft to a controlled stop.

* * * * *